United States Patent [19]

Corsette

[11] Patent Number: 4,779,803

[45] Date of Patent: Oct. 25, 1988

[54] MANUALLY ACTUATED LIQUID SPRAYER

[75] Inventor: Douglas F. Corsette, Los Angeles, Calif.

[73] Assignee: Calmar, Inc., Watchung, N.J.

[21] Appl. No.: 895,368

[22] Filed: Aug. 11, 1986

[51] Int. Cl.[4] ..... B05B 1/26; B05B 1/34

[52] U.S. Cl. ..... 239/428.5; 239/504; 239/512

[58] Field of Search ..... 239/343, 289, 491, 428.5, 239/437–439, 370, 311, 507, 504, 451, 456, 587, 499, 390, 441, 600, 391, 467, 505, 516, 512

[56] References Cited

U.S. PATENT DOCUMENTS

| | | | |
|---|---|---|---|
| 1,354,641 | 10/1920 | Zietlow | 239/507 |
| 2,717,614 | 9/1955 | Palivos | 239/428.5 X |
| 3,961,754 | 6/1976 | Kuhns et al. | 239/289 |
| 3,964,689 | 6/1976 | Horvath, Jr. | 239/318 |
| 4,013,228 | 3/1977 | Schneider | 239/311 X |
| 4,135,670 | 1/1979 | Sugimoto | 239/553.3 X |
| 4,219,159 | 8/1980 | Wesner . | |
| 4,252,276 | 2/1981 | Aprea et al. | 239/499 X |
| 4,350,298 | 9/1982 | Tada . | |
| 4,463,905 | 8/1984 | Stoesser . | |
| 4,494,699 | 1/1985 | Hengesbach | 239/499 |

FOREIGN PATENT DOCUMENTS 1045595 1/1979 Canada .

*Primary Examiner*—Andres Kashnikow
*Assistant Examiner*—Mary Beth O. Jones
*Attorney, Agent, or Firm*—Watson, Cole, Grindle & Watson

[57] ABSTRACT

A manually actuated liquid sprayer has an element mounted on its nozzle for movement parallel to the axis of the discharge orifice between retracted and extended positions relative to the front wall of the nozzle, the element having a thickness not greater than the lateral extent thereof, lying against the front wall in the retracted position and being spaced from such wall in the extended position. The element has an open port coaxial with the discharge orifice and of a size greater than that of the orifice, the element comprising a mitigating element for mitigating the divergent spray issuing from the orifice. The open port is sized relative to that of the spray plume such that the mitigating element has no effect on the liquid spray as it passes through the open port without influence from any portion thereof in the retracted position, and such that the mitigating element is engaged only as it is extended to a position spaced from the forward wall of the nozzle to produce the intended modulation of the spray which emerges from the forward side of the element.

7 Claims, 2 Drawing Sheets

MANUALLY ACTUATED LIQUID SPRAYER

BACKGROUND OF THE INVENTION

This invention relates generally to a manually actuated liquid sprayer having a telescopically mounted spray mitigating element capable of being manually shifted between out of service and in service positions.

Known pump sprayers have attachments of various types for mitigating or modulating the spray discharge especially for use a foam dispenser. For example, U.S. Pat. No. 4,350,298 discloses a foam dispenser in which a nozzle cap is mounted for movement to a foam position, the cap having a plurality of arms lying in the path of the discharge spray plume and consituting an obstacle wall or spattering device with which the spray liquid from the orifice collides. The nozzle cap is shifted axially relative to the discharge orifice from an extended foaming position to a retracted position in which the discharge orifice is plugged closed. Otherwise, the nozzle cap may be hingedly mounted in place so as to be pivoted between foaming and non-foaming positions. Although the hinged nozzle cap permits the dispenser to be used as a normal sprayer as well a foamer, the hinged cap can be unwieldy and confusing for the operator in having to snap it into and out of place.

Another foamer is disclosed in U.S. Pat. No. 4,219,159 as having a mesh screen or screens fixed in the path of discharge to facilitate liquid particle breakup on dispensing.

In U.S. Pat. No. 4,463,905, a pump sprayer has a mesh screen hinged for movement between foaming and non-foaming positions.

Another manually actuated sprayer is disclosed in my prior application, U.S. Ser. No. 890,277, filed July 29, 1986, and entitled "Sprayer Having Induced Air Assist". A ported baffle plate presents a gap with the wall containing the discharge orifice so as to define an unobstructed air plenum, the open port being sized to encircle the spray plume at the location of the baffle so that the spray plume substantially fills the port as air in the gap is driven through the port by impingement of the spray particles issuing from the orifice which thereby entrains air laterally from the plenum into the spray plume for creating a turbulent effect which increases collisions between the spray particles, prevents any backflow of air through the port and adds air mass and mixing with the spray particles resulting in a finer and more consistent spray particle breakup.

Canadian Pat. No. 1,045,595 discloses an adjustable foam generating sprayer having a nozzle unit forming a pressure reducing passageway defined by a tapered passageway portion and an adjoining elongated throat portion. The divergent stream issuing from the discharge orifice strikes progressively increasing areas of the outwardly tapered and throat portions of the pressure-reducing passageway as the position of the nozzle unit is adjusted relative to the orifice for adjusting the quality of the foam of the stream flowing from the nozzle unit. If little or no foaming action is desired, the nozzle unit is adjusted so that the widest portion of the diverging stream strikes the interior of the elongated throat portion.

However, none of the aforementioned foamers provides for mitigation or modulation of the divergenet spray cone only in an extended position of a ported element which, when retracted in a direction parallel to the axis of the discharge orifice, produces no effect on the spray plume as it freely passes through the open port.

SUMMARY OF THE INVENTION

The manually actuated sprayer of the invention has a nozzle containing a discharge orifice located in an outer wall through which liquid is capable of being discharged in the form of a divergent liquid spray plume of a given size in forward direction. An element is mounted on the nozzle for movement parallel to the axis of the discharge orifice between retracted and extended positions relative to the outer wall which contains the orifice. The element has an open port coaxial with the discharge orifice and of a size greater than that of the discharge orifice. The element comprises means for mitigating the divergent spray, although such mitigating means has an affect on the spray only in the extended position of the element so as to produce a finer and more consistent spray particle breakup as the liquid spray emerges from the forward side of the element. In the retracted position of the element, no mitigating affect on the divergent spray is produced as the liquid spray passes through the open port freely and out of contact with any portion of the retracted element.

The element is mounted on the nozzle for telescoping sliding movement, the nozzle having a plurality of spaced apart elongated openings parallel to the orifice, and the element having a like plurality of support legs received within such openings for relative sliding movement. Cooperating stops acting between the support legs and the nozzle may be provided for limiting outward sliding movement of the element.

The element may comprise a ported baffle plate having opposed surfaces exposed to the atmosphere and presenting a gap with the nozzle outer wall in the extended position of the baffle plate so as to define an unobstructed air plenum including the adjacent atmosphere.

Otherwise, the element may comprise a frame having spaced arms supporting a central ring defining the open port, the arms and the ring serving as the mitigating means.

Still further, the element may comprise a frame supporting a mesh screen having an opening defining the open port, and in which the screen serves as the mitigating means.

Other advantages and novel features of the invention will become more apparent from the following detailed description of the invention when taken in conjunction with the accompanying drawings.

BRIEF DESCRIPTIONS OF THE DRAWINGS

DETAILED DESCRIPTION OF THE INVENTION

Figure 1:
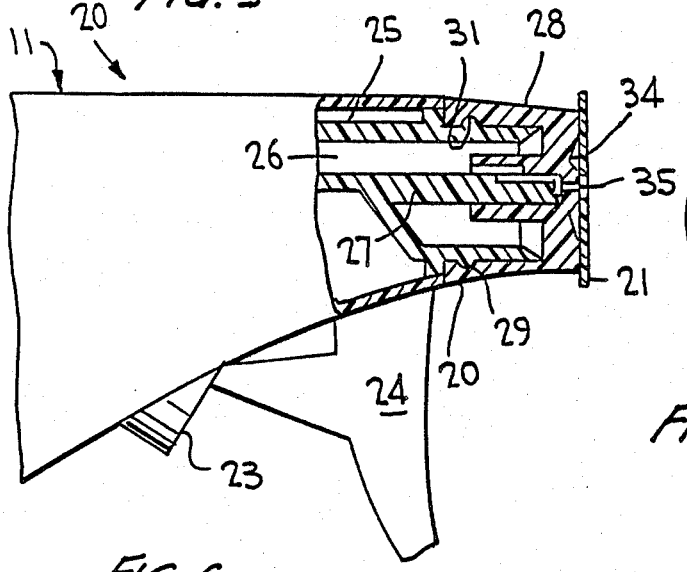
FIG. 1 is a schematic side view of a pump sprayer, partly in section, incorporating the invention.
Figure 2:
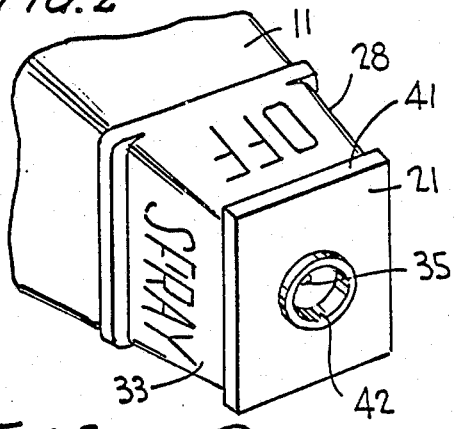
FIGS. 2, 3, 4 and 5 are fragmentary perspective views of the FIG. 1 sprayer respectively illustrating off, stream and two spray positions of the nozzle.
Figure 3:
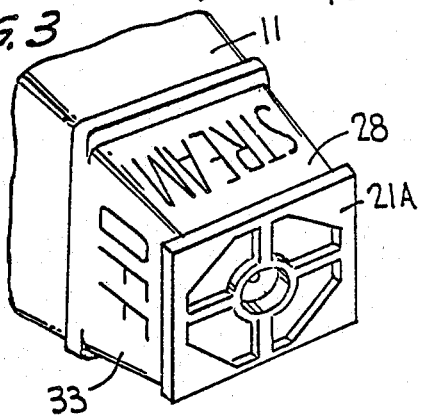

Turning now to the drawings wherein like reference characters refer to like and corresponding parts throughout the several views, a liquid dispenser 20 is shown in FIG. 1 in the form of a manually operated trigger pump sprayer having a ported movable element 21 generally shown mounted thereon. However, the invention is likewise adapted for manually operated vertical action pump sprayers, foamable or squeeze bottle sprayers and aerosols.

A sprayer body 22 of the dispenser includes a pump cylinder 23 containing a reciprocable pump piston (not shown) manually reciprocated by a trigger actuator 24 hingedly mounted on the body. An outlet housing member 25 of the dispenser has a discharge conduit or passage 26 through which liquid product is adapted to pass during the pumping operation. A fixed, coaxial core or plug element 27 is formed in the outlet member, and a nozzle 28 is externally mounted on the end of the outlet member by a snap fit produced between an external rib 29 on member 25 and an internal groove 31 on the cap skirt. As more clearly shown in FIGS. 6, 7 and 8, the nozzle skirt is formed as having an inner cylinder 32, and outer flat walls 33 connected to cylinder 32 and together being of rectangular configuration. Internal groove 31 is formed in the inner surface of cylinder 32. The external flat walls of the nozzle facilitate manual rotation of the nozzle on the outlet member and may conveniently receive markings on each of four side walls, such as OFF, STREAM and SPRAY, as shown in FIGS. 2 to 5.

The nozzle cap has an outer or end wall 34 containing a discharge orifice 35 coaxial with member 27, and may be similar to that disclosed in U.S. Pat. No. 4,618,077.

And, the dispenser may have a swirl or spin chamber to internally effect a vortex of the liquid product causing the product to discharge from orifice 35 as a spray plume typically in the form of a diverging spray cone. Spin mechanics which may be employed for producing a vortex of the liquid product is disclosed, for example, in U.S. Pat. No. 4,624,413. Other spin mechanics may be employed as for example disclosed in U.S. Pat. No. 4,706,888.

Element 21, when in an extended position relative to outer wall 34, functions to mitigate or modulate the spray plume resulting in a finer and more consistent spray particle breakup in a manner to be described in more detail hereinafter for the several embodiments. Element 21 may be flat, as shown, so as to lie flatwise against outer flat wall 34 of the nozzle. Otherwise, if wall 34 of the nozzle or of a dispenser containing the discharge orifice were contoured, element 21 would be complementarily contoured.

Figure 6:
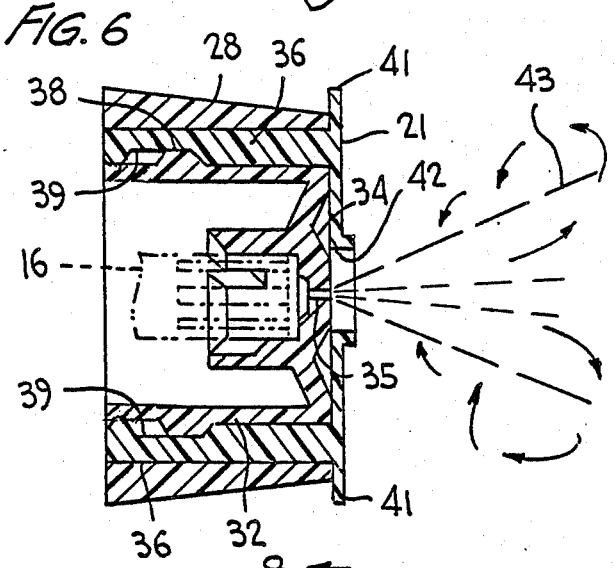
FIG. 6 is an enlarged sectional view of the FIG. 1 nozzle having an element according to one embodiment of the invention shown mounted thereon in a retracted and out of service position.
Figure 7:
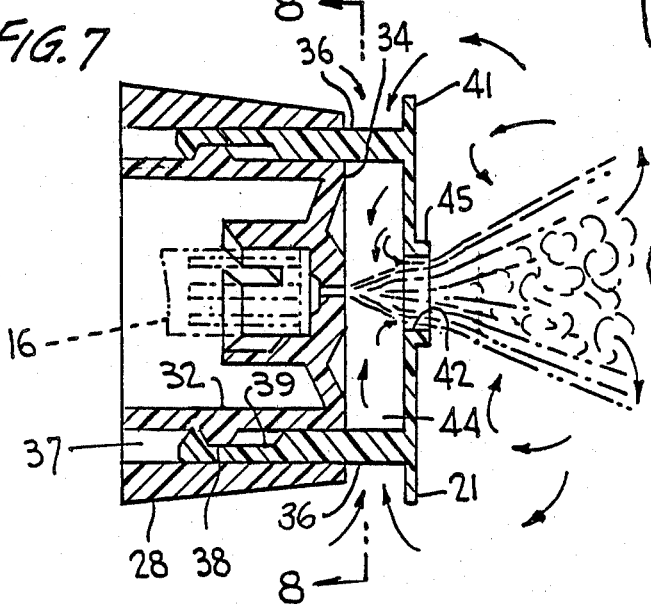
FIG. 7 is a view similar to FIG. 6 showing the element extended into a spray discharge plume enhancing position.
Figure 8:
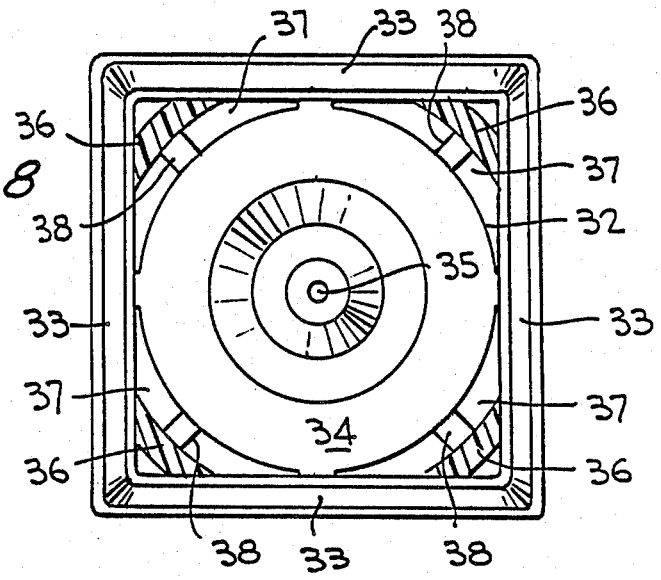
FIG. 8 is a view taken substantially along the line 8—8 of FIG. 7.

Element 21 is telescopically mounted on the nozzle for movement between the retracted position of FIG. 6 to its extended position of FIG. 7. A plurality of support legs 36 on element 21 project into a like plurality of elongated openings 37 located in the nozzle and opening into outer wall 34. As shown in FIG. 8, openings 37 are conveniently provided at the four corners between inner cylinder 32 and flat walls 33 of the cap skirt, although a different number of openings and support legs may be provided without departing from the invention. And, radial projectings 38 may be formed on the outer wall of cylinder 32 of the cap so as to project into openings 37. Elongated slots 39 may be formed at the inner sides of support legs 36 for receiving each projection 38, end walls of the slots being matched to and engaging projections 38 for limiting the outward extent of element 21 to its FIG. 7 position.

Element 21 may extend outwardly of one or more side walls 33 of the nozzle, as at 41, so as to provide gripping means for facilitating manual sliding movement of the element. And, in the embodiment of FIGS. 6 and 7, element 21 is in the form of a baffle plate having an open port 42 therein coaxial with the discharge orifice, and of a size greater than that of orifice 35.

As in accordance with my prior application, U.S. Ser. No. 694,101, or in accordance with the aforementioned application Ser. No. 884,437, the nozzle is rotatable about its central axis into the OFF position of FIG. 2 in which discharge through the orifice is closed. Rotation of the nozzle through 360° in either direction in 90° increments closes off or selects the discharge. Rotation of the nozzle through 90° from the OFF position in one direction, as in FIG. 3, facilitates discharge of product, during pumping, such as a stream, and rotation of the nozzle into its spray position of FIG. 4 facilitates discharge of product in the form of a divergent liquid spray plume 43. The coaxial open port 42 of element 21 is sized relative to that of the spray plume such that the baffle plate has no effect on the liquid spray which freely passes through the coaxial open port without contacting any portion of element 21 in its retracted position of FIG. 6. The liquid product discharged as spray plume 43 is of a given size depending on the nature of the liquid being discharged, the size and distance of the target area, the discharge pressure and volume, etc. Thus, with the baffle plate retracted in its position of FIGS. 4 and 6, spray discharge is carried out in the normal fashion.

Figure 4:
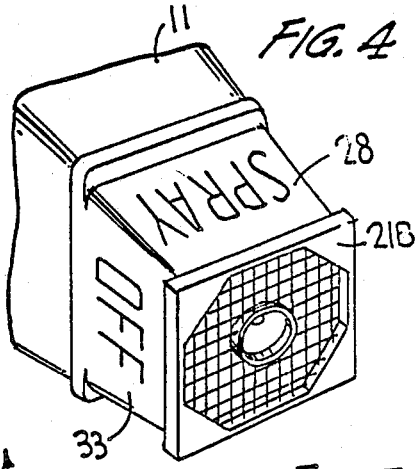
Figure 5:
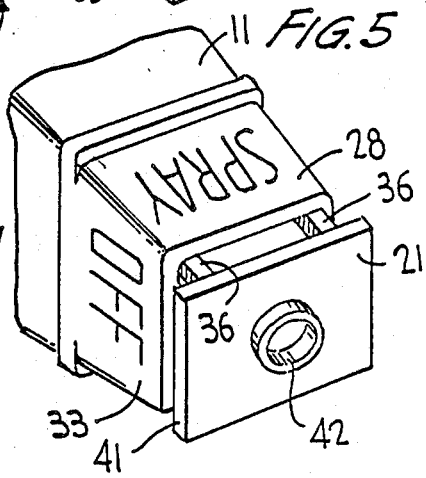

When in the FIG. 4 spray position of the nozzle, the baffle plate may be pulled outwardly, as shown in FIG. 5, into a position spaced from outer wall 34 of the nozzle for enhancing the spray discharge resulting in a finer and more consistent spray particle breakup. This mitigating effect is the same as that described in detail in my prior application Ser. No. 890,277, and entitled "Sprayer Having Induced Air Assist". Thus, the size of open port 42 is designed to approximate the size and/or divergence angle of spray plume 43 at a given outwardly extended position of the ported baffle. In this extended position, the opposed surfaces of the ported baffle are exposed to the atmosphere, and the plate presents a gap with outer wall 34 so as to define an unobstructed air plenum which includes the adjacent atmosphere. The spray plume is thus caused to jump the gap between the discharge orifice and port 42 in the baffle plate. By sizing the port to suit the size and/or divergence angle of the discharge plume, air in the gap is driven through port 42 by impingement of the spray particles and entrainment of the air into the plume from the gap. The provision of an external baffle plate with an appropriately sized port causes a controlled, induced air flow into that portion of the discharge plume immediately as it emerges from the discharge orifice to add turbulence transverse to the discharge axis. This will increase the collisions between the spray particles and the discharge and add air mass and mixing, resulting in a finer, more consistent liquid particle breakup. If the product discharge is a foamable product or has a foaming ingredient, the ported baffle will cause the discharge to be converted to a foam as it emerges from the baffle port. Should the discharge be converted from a divergent cone to a stream 43 (upon nozzle rotation), or to a narrower spray which does not bear the correct functional relationship to the port in the baffle, or if the ported baffle is partially extended so that its open port does not bear the correct functional relationship to the size and/or divergence angle of the discharge plume, then the enhancement factor is not in effect and the discharge plume or stream is essentially unaffected.

The gap is part of an air plenum 44 into which induced air is caused to flow laterally to the axis of the discharge plume as represented by the air arrows in FIG. 7. This air plenum should be free of any obstructions which would prevent an unobstructed flow of air, without interference, transversely to the plume axis for creating a turbulent effect which increases collisions between the spray particles immediately upon the spray issuing from the discharge orifice. Support legs 36 present no appreciable obstruction to the flow of air into the air plenum since the total cross sectional area of the legs represents less than about 1% of the total cross sectional area of the air plenum.

For the purpose of accommodating various physical properties, spray, and/or foamability characteristics coupled with the different operating pressures generated by different users, the size of the baffle port and the thickness of the baffle plate in the region of the open port will be chosen for a typical application having some range of effectiveness. Thus, the baffle plate may be provided with a thickened central portion 45 in the region of open port 42, and the parameters as to the size of the gap between the discharge orifice and the baffle plate, the size of the baffle port, etc, will be configured depending on the nature of the fluid being discharged, the size and distance of the target area, the discharge pressure and volume, etc. Nevertheless, the open port, with or without thickened portion 45, will be sized relative to that of the spray plume such that the baffle plate has no affect on the liquid spray in the retracted position of the plate shown in FIG. 6.

Although discharge orifice 35 and open port 42 are illustrated as straight cylindrical sections, the orifice and/or port may be made outwardly converging, and/or outwardly diverging or combinations thereof, without departing from the invention. The various shapes of the discharge orifice and open port will be dictated by the nature of the liquid being discharged, the size and distance of the target area, the discharge pressure and volume, the effect desired, etc.

Figure 9:
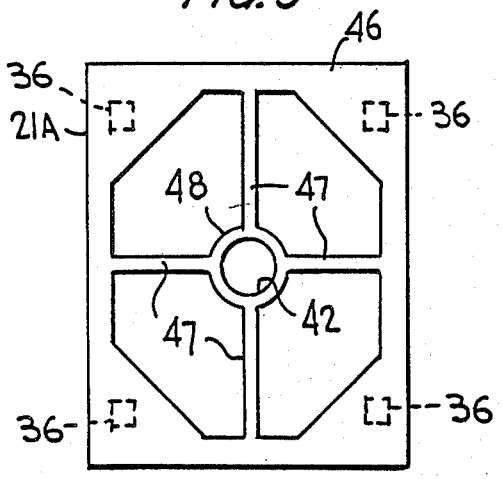
FIG. 9 is a front view of another embodiment of the spray mitigating element of the invention.
Figure 10:
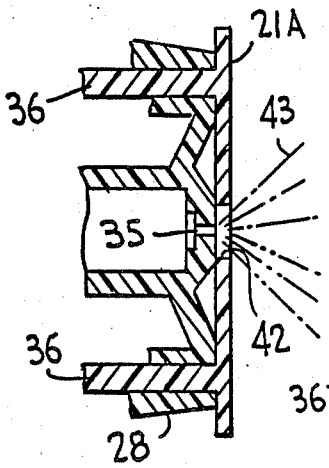
FIGS. 10 and 11 are fragmentary sectional views, similar to FIGS. 6 and 7, of the FIG. 9 element respectively in retracted and extended positions.
Figure 11:
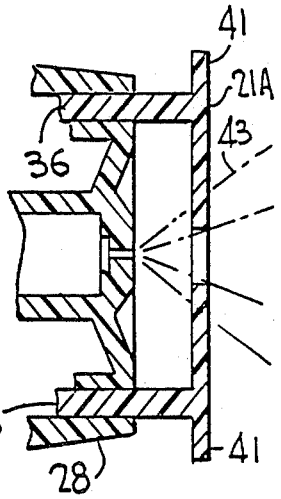

FIG. 9 illustrates another embodiment of the mitigating element, designated 21A, in the form of a frame 46 having a plurality of spaced arms 47 supporting a central ring 48 which defines open port 42. The arms may be in a cruciform configuration as shown, or may be in any other configuration, without departing from the invention. In the retracted position of FIG. 10, mitigating element 21A has no affect on spray plume 43 which, as described in reference to FIG. 6, passes through open port 42 without contacting any portion of the element. Element 21A has support legs 36 extending into openings 37 of the nozzle cap for telescoping sliding movement in the same manner as described with reference to FIGS. 6 and 7. When element 21A is pulled outwardly into its extended position of FIG. 11, ring 48 and arms 47 will lie in the path of the divergent spray cone and thus form an obstacle against which the spray impinges for producing particle breakup similarly as that described in U.S. Pat. No. 4,350,298. Thus, a finer and more consistent spray particle breakup is produced as the liquid spray emerges from the forward side of element 21A. Of course, if the liquid product discharged has a foaming ingredient or is otherwise foamable, the discharge will emerge as a foam.

Figure 12:
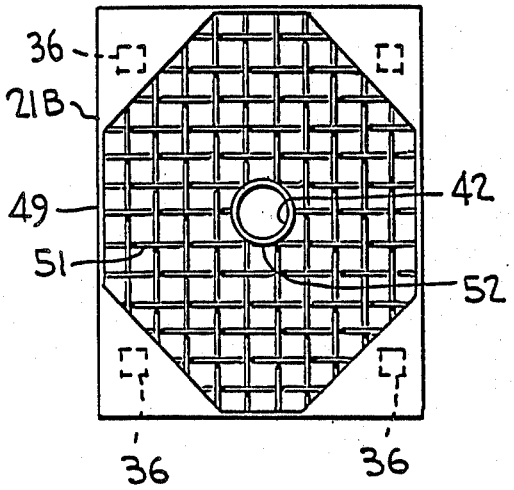
FIG. 12 is a front view of another spray mitigating element of the invention.
Figure 13:
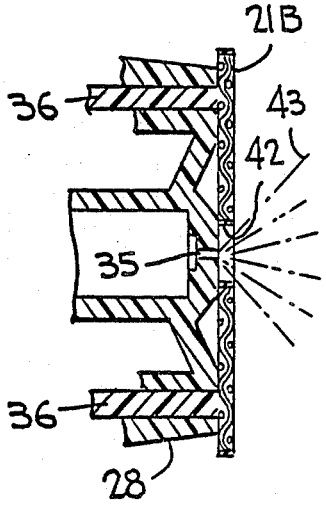
FIGS. 13 and 14 are fragmentary sectional views, similar to FIGS. 10 and 11, of the FIG. 12 element in its retracted and extended positions.
Figure 14:
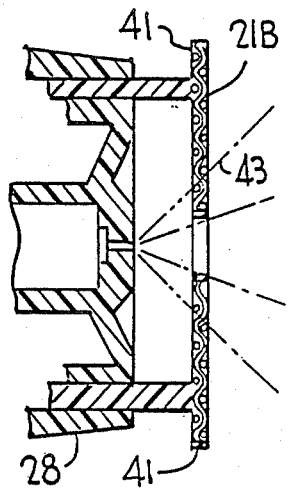

Another embodiment of the movable mitigating element is shown in FIG. 12 in which element 21B comprises a frame 49 supporting a grid such as a mesh screen 51 having an opening which defines open port 42. This opening may be delimited by a ring 52 or the like. Again, in the retracted position of FIG. 13, element 21B has no effect on the divergent spray plume issuing from the discharge orifice which freely passes through open port 42 without contacting any portion of the element. Enlarged corner sections of frame 49 support legs 36 for telescopically mounting the element in place, in the same manner as aforedescribed. In the extended position of FIG. 14, the mesh screen lies in the path of the divergent spray cone for thereby mitigating the spray as it impinges against the mesh and emerges from forward end thereof as a fine spray or foam as a finer and more consistent spray particle breakup is produced which may be similar to that disclosed in U.S. Pat. Nos. 4,219,159 and 4,463,905.

From the foregoing, it can seen that a simple and economical yet highly reliable spray mitigating element is provided for a liquid sprayer and is capable of being placed in and out of service by telescopically mounting it to the nozzle cap.

Obviously, many other modifications and variations of the present invention are made possible in the light of the above teachings. It is therefore to be understood that within the scope of the appended claims the invention may be practiced otherwise than as specifically described.

What is claimed is:

1. A manually actuated liquid sprayer having a nozzle containing a discharge orifice located in an outer wall through which liquid is capable of being discharged in the form of a divergent liquid spray plume of a given size in a forward direction, a ported baffle plate having a single open port coaxial with said orifice and of a size greater than that of said orifice, said plate being mounted on said nozzle for movement parallel to the axis of said discharge orifice between retracted and extended positions relative to said outer wall, and said ported baffle plate having opposed surfaces exposed to the atmosphere and presenting a gap with said outer wall in said extended position so as to define and unobstructed air plenum which includes the adjacent atmosphere to thereby effect mitigation of the divergent spray, said open port being sized relative to that of said spray plume such that there is no mitigating effect on the liquid spray as it passes through said open port without influence from any portion thereof in the retracted position of said plate, and such that the mitigation is effected only as said plate is extended to a position forward of said nozzle outer wall to produce the intended modulation of the spray which emerges from the forward side of said plate.

2. A manually actuated liquid sprayer having a nozzle containing a discharge orifice located in an outer wall through which liquid is capable of being discharged in the form of a divergent liquid spray plume of a given size in a forward direction, a perforate plate having a plurality of through openings and having a single open port coaxial with said orifice and of a size greater than that of said orifice, said plate being mounted on said nozzle for movement parallel to the axis of said discharge orifice between retracted and extended positions relative to said outer wall, and said plate comprising means for mitigating the divergent spray, said open port being sized relative to that of said spray plume such that said mitigating means has no effect on the liquid spray as it passes through said open port without influence from any portion thereof in the retracted position of said plate, and such that said mitigating means is engaged only as said plate is extended to a position forward of said nozzle outer wall to produce the intended modulation of the spray which emerges from the forward side of said plate.

3. The sprayer according to claims 1 or 2, wherein said plate is telescopically mounted for sliding movement on said nozzle.

4. The sprayer according to claims 1 or 2, wherein said nozzle has a plurality of spaced apart elongated openings lying parallel to said orifice and opening into said outer wall, said plate having a plurality of support legs received within said openings for telescoping sliding movement on said nozzle.

5. The sprayer according to claim 4, wherein cooperating stop means acting between said legs and said nozzle limit outward sliding movement of said plate.

6. The sprayer according to claim 2, wherein said perforate plate comprises a frame having spaced arms supporting a central ring defining said open port, said arms and said ring constituting said mitigating means.

7. The sprayer according to claim 2, wherein said perforate plate comprises a frame supporting a mesh screen having an opening defining said open port, said screen constituting said mitigating means.

* * * * *